United States Patent [19]

Mitzner

[11] Patent Number: 4,673,022

[45] Date of Patent: Jun. 16, 1987

[54] ARRANGEMENT FOR THE CHANGING OF IMPLEMENTS IN FOUNDRY MACHINES

[75] Inventor: Horst Mitzner, Viersen, Fed. Rep. of Germany

[73] Assignee: Rheinische Maschinenfabrik Eisengiesserei Anton & Poper GmbH & Co., Fed. Rep. of Germany

[21] Appl. No.: 876,645

[22] Filed: Jun. 17, 1986

Related U.S. Application Data

[63] Continuation of Ser. No. 668,305, Nov. 5, 1984, abandoned.

[30] Foreign Application Priority Data

Nov. 8, 1983 [DE] Fed. Rep. of Germany ..... 3340267
Feb. 15, 1984 [DE] Fed. Rep. of Germany ..... 3405420

[51] Int. Cl.[4] ..... B22C 15/24; B22D 33/04

[52] U.S. Cl. ..... 164/201; 164/137; 164/341; 164/342; 29/564.1

[58] Field of Search ..... 164/386, 12, 16, 200–202, 164/19–21, 137, 339–342; 29/564.1; 339/46

[56] References Cited

U.S. PATENT DOCUMENTS

| | | | |
|---|---|---|---|
| 3,253,304 | 5/1966 | Hatch | 164/12 |
| 3,528,481 | 9/1970 | Lund | 164/16 |
| 3,543,392 | 12/1970 | Perry et al. | 29/564 |
| 3,556,195 | 1/1971 | Lund | 164/16 |
| 3,817,314 | 6/1974 | Deve | 164/200 |
| 4,083,396 | 4/1978 | Michelson | 164/201 |
| 4,210,194 | 7/1980 | Cina et al. | 164/16 |

FOREIGN PATENT DOCUMENTS

| | | | |
|---|---|---|---|
| 156640 | 12/1980 | Japan | 164/16 |

*Primary Examiner*—Nicholas P. Godici
*Assistant Examiner*—Sam Heinrich
*Attorney, Agent, or Firm*—Scully, Scott, Murphy and Presser

[57] ABSTRACT

An arrangement for the exchange of implements in foundry or mold casting machines, in which the implement is moved from a changing station towards an implement receiving and work station, and there connected with the implement holder.

18 Claims, 2 Drawing Figures

ARRANGEMENT FOR THE CHANGING OF IMPLEMENTS IN FOUNDRY MACHINES

This application is a continuation of application Ser. No. 668,305, filed 11/5/84, now abandoned.

BACKGROUND OF THE INVENTION

1. Field of the Invention

The present invention relates to an arrangement for changing of molds in foundry or mold casting machines, in which the mold is moved from a changing station to a receiving and work station, and there connected with means for holding the mold.

2. Discussion of the Prior Art

Changing work tools or molds in foundry machines usually requires stationary or mobile hoisting tools, which are used to locate the mold in the operative position. This changing procedure is complex and frequently subject to accidents. Moreover, the molds which, as a rule, are multipart molds, are cleaned within the machine, and this is relatively difficult to do.

Also known in the art are arrangements in which the new and old molds are mounted on a rotatably supported mold holder, and these molds are transferred by swinging the new part into the machine and then into operation. This type of arrangement is disclosed in German Pat. No. 31 48 461.

For this purpose, a part of the new mold is arranged on a second mold holder of the machine, and then pivoted into the operative position. The disadvantages of this arrangement are that the actual exchange of the mold must be done, as heretofore, through external hoisting instruments or tools, with a corresponding danger of accidents, and a second mold holder is required, resulting in duplication of structural components.

SUMMARY OF THE INVENTION

Accordingly, an object of the present invention is to provide an arrangement for eliminating the above-mentioned disadvantages, in that complete tools or molds are positioned outside the actual work area of the machine, but in association with the machine, and are securely inserted into the machine and rapidly connected with the mold holder. The arrangement can be utilized in a reverse sequence for the removal of tools or implements. A particular object of this invention is to apply this principle to multi-part molds.

The invention facilitates the assembly of multi-part molds in the machine without adversely affecting operation of the machine. The individual parts of the mold can be brought together, from different storage magazine areas, into the changing station of the machine and assembled therein into the complete mold which can then be moved a short distance into the work area of the machine and there connected with the mold holder. A mold piece that is to be assembled can be moved a similarly short distance into the changing station and there assembled. When the mold piece is heated during operation, as is common in foundry machines, the mold can be deposited in the changing station, without any waiting period for the mold to cool, and thereafter disassembled. In a similar way, a new mold which is to be inserted into the machine, and which is heated during operation, can be pre-heated in the changing station and then assembled so that it is, after assembly, immediately ready for operation.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
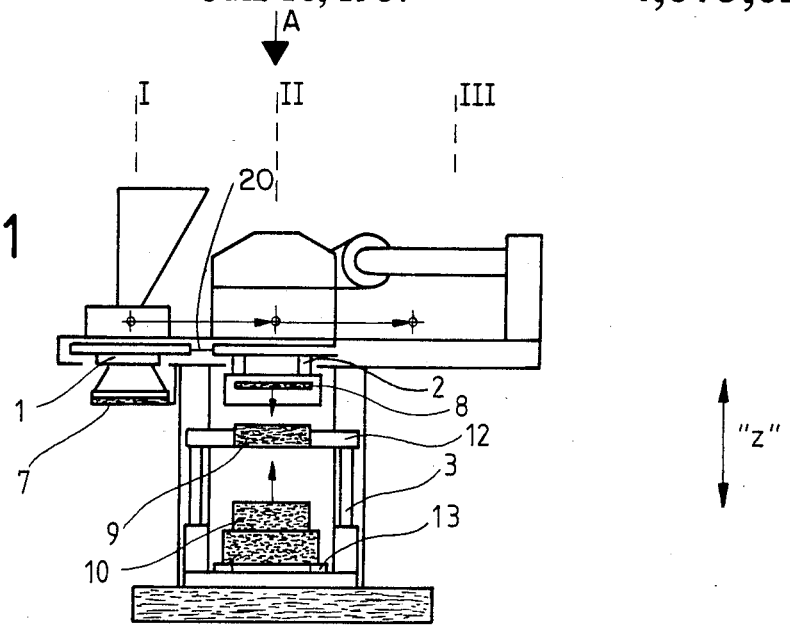
FIG. 1 is a generally schematic side elevational view of a foundry machine, specifically a core blasting and hardening automatic apparatus, with a horizontally divided mold.
Figure 2:
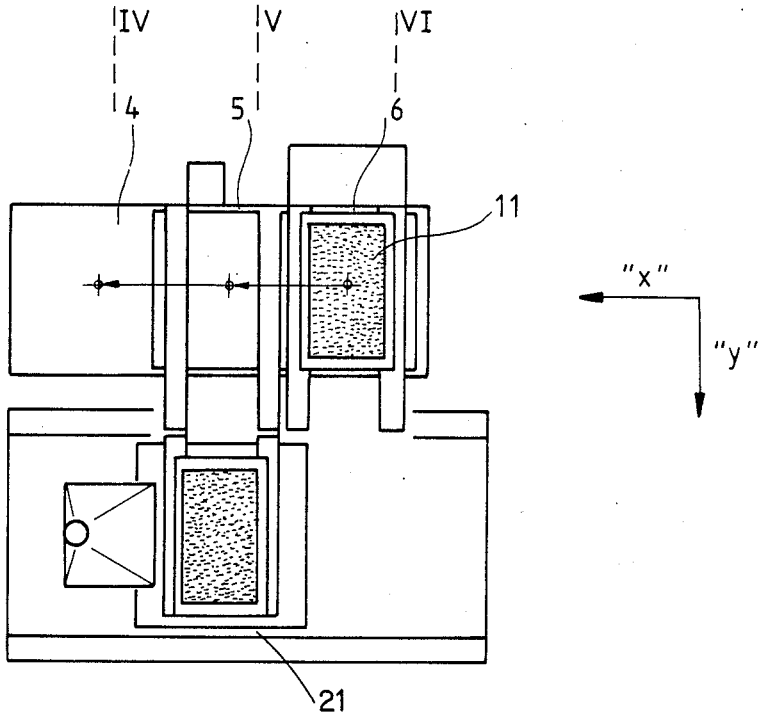
FIG. 2 is a plan view of the machine shown in FIG. 1 taken along the direction of arrow A of FIG. 1.

The invention relates to a machine including a movable core blasting unit 1, a movable hardening unit 2, and a clamping device 3. A changing station 4, including two loading stations 5 and 6, is located adjacent the above-described machine. A multi-part mold is located in the foundry machine, and this mold includes a blasting headplate 7, ejector plate 8, and a core box having upper portion 9 and lower portion 10. The blasting unit 1 and the hardening unit 2 are movable together along a slide carriage 20.

The mold parts 7, 8, 9 and 10 are the components of a mold which is assembled from these parts and used to form hardened molding cores, such as are utilized in the foundry or mold casting technology.

When the upper portion 9 and lower portion 10 of the core box, and the blasting headplate 7 are assembled together in the work area of the machine, below the blasting head of the blasting unit, sand can be introduced into the core box 9, 10 under pressure from the blasting unit. To do this, with particular reference to FIG. 1, the blasting unit 1 is moved from the position I into the position II, the lower portion 10 of the core box is raised in the direction of arrow A to a position below the upper portion of the core box, and the blasting headplate 7 is lowered onto the upper portion 9 of the core box. When a core is formed in the core box 9, 10, then the blasting unit and the hardening unit 2 are moved, through horizontal displacement of the slide carriage 20, so that the blasting unit is brought from the position II into the position I and the hardening unit 2 is moved from the position III into the position II. The blasting headplate 7 is thereby removed, together with the blasting unit, from the core box and brought from the position II into the position I. This same movement of the carriage brings hardening unit 2 into the position II; and the hardening unit, with the interposition of an ejector plate, is lowered onto the upper portion 9 of the core box to harden the previously produced core. The hardening of the cores is thus effected immediately after the formation thereof.

During this core formation, another mold piece 11, which is to be used during a subsequent production of a differently shaped core, can be assembled in the loading station 6 of the changing station 4, and the changing station may be provided with any suitable means to do this. This is done outside the machine work area which in essence is the mold holding and work station 21 of the machine. The mold 11 has basically the same construction as, but a shape different from, the shape of the work tool formed from components 8–10.

To change molds, the hardening unit 2 is moved from position II into position III, while the blasting unit 1 is concurrently moved from position I into position II. Thereafter, the lower portion 10 of the core box is moved vertically upwardly until it is below the upper portion 9 of the core box. After the blasting unit 1 is lowered and the blasting head plate 7 is released so that this headplate lies on the upper portion 9 of the core box, the blasting unit 1 is raised and returned into position I. The hardening unit 2 is now moved from position III to position II, lowered onto the blasting headplate 7 and released from the ejector plate 8.

Thereafter, the upper portion 9 of the core box is released from the upper frame 12 of the clamping device 3. During the subsequent lowering of the lower frame 13 in the "z" direction down to the level of the changing station 4, the mold components 10, 9, 8 and 7 form a unit and this work tool unit is then brought in the "y" direction into the open loading or processing station 5.

The thus occupied loading or processing stations 5 and 6 are thereupon moved together horizontally in the "x" direction in such a manner that the mold which has been removed from the machine is carried from the position V into the position IV, and the new mold 11 is carried from the position VI into the position V.

The mold 11, which is identical in construction with the removed mold 7 through 10, is mounted by initially moving the mold 11 in the "y" direction onto the implement holding and work station 21, and then into the clamping device 3.

Thereafter the following operating steps and movements are implemented:

The clamping device 3 is closed through the upward movement of the lower frame 13 to raise the new mold 11 to a position where the upper portion of the core box of the new mold can be connected to the upper frame 12 of the clamping device 3;

the hardening unit 2 is lowered and clamped to the ejector plate 8;

the upper portion 9 of the core box is connected with the upper frame 12;

the hardening unit 2, together with the ejector plate 8, is raised and moved into the position III;

the blasting unit 1 is moved from position I to II, lowered and then clamped together with the blasting headplate 7;

the blasting unit 1 is raised, and the clamping device 3 is opened by lowering the lower frame 13.

The mold unit change is thereby completed. The old mold can be disassembled at the loading or processing station 4, during the mounting of the new mold or during the production of cores with the new mold unit, and station 4 may be provided with any suitable means to disassemble the removed mode.

The above-described change of horizontally divided or separated mold units is also applicable to vertically divided molds by means of a corresponding clamping device.

Consequently, the invention discloses a novel arrangement for the automatic change and fastening of molds. Such an arrangement is particularly useful for example, in foundry machines employed in the production of casting molds, cores and ingot molded products.

The inventive arrangement significantly reduces the time needed to change molds. Moreover, with the present invention, it is possible to position the mold components outside the machine without disrupting the operating cycles thereof. The invention additionally reduces the danger of accidents since it is not necessary for personnel to reach into the machine during the transfer of the mold.

With this invention, molds or tools which must be maintained at an elevated working temperature during operation of the machine may be pre-heated, significantly reducing the heretofor necessary interruptions in the operating cycle of the machine during a mold transfer. Apparatus required to do this, such as thermoelements, control lines for switching functions and the like, may be automatically connected to the mold.

The arrangement of this invention provides the prerequisite condition for the preparation and the movement of molds towards and from the mold storage area by means of pregiven coding.

The paths of movement of the individual stations in the three directions x, y, z can be effected through usual means; for example, through electrical drive motors, chain drives and couplings, or through hydraulically or pneumatically actuated operating cylinders. The specific means utilized for this purpose, in themselves, are not essential to the invention.

The interconnection between the mold components 7, 8, 9 and 10 or, respectively, the applicable components of the new mold 11, on the one hand, and the machine components consisting of the blasting unit 1, the hardening unit 2 and the upper frame 12 and the lower frame 13 of the clamping device 3 which hold or pickup these components, is made by connecting means of the type that can be rapidly or quickly operated to connect elements together and to disconnect elements from each other, and such rapid operating connecting means are referred to herein as "snap closures." Such connecting means are also known per se and are not described in detail, and the only importance of these closures is the manner in which they are utilized in this invention. For mold units that need them, snap closures are provided to connect the mold unit, which is to be inserted into the machine, to a suitable energy supply, such as an electric voltage source, and to disconnect the mold unit, which is to be removed from machine, from the energy source.

What is claimed is:

1. In combination with a foundry machine including a blasting unit, a hardening unit and a work station for supporting molds, an arrangement for changing said molds, the improvement comprising:

the foundry machine further includes i. a slide carriage supported for horizontal reciprocating movement along a first axis, and ii. means to lower and raise a first mold along a second vertical axis between the work station and an operating position;

the blasting unit and hardening unit are held by the carriage for horizontal movement along the first axis between first and second positions; in the first position, the blasting unit is located directly above the operating position of the first mold and the hardening unit is located forward thereof; and in the second position, the hardening unit is located directly above the operating position of the first mold unit and the blasting unit is located rearward thereof;

a changing station located outside and adjacent the foundry machine for holding a second mold; and means for transferring the first mold from the work station to the changing station, and for transferring the second mold from the changing station to the work station.

2. An arrangement as claimed in claim 1, wherein the second mold includes a multitude of parts, and means to releasably connect said parts together, and the improvement further comprises:

means for carrying the parts of the second mold from a supply of said parts to the changing station; and assembly and disassembly means located at the changing station to connect together and to disconnect the parts of the second mold to assemble and disassemble the second mold.

3. An arrangement as claimed in claim 2, wherein the foundry machine further includes a mold holder, and the improvement further comprises snap closures for connecting the first mold to the mold holder.

4. An arrangement as claimed in claim 3, wherein said snap closures comprise means to connect the first mold to an energy source upon connecting said first mold to the mold holder.

5. An arrangement as claimed in claim 1, wherein the transferring means comprise hydraulic, pneumatic or electromagnetic operated means for moving the first and second molds between the changing station and the work station.

6. An arrangement as claimed in claim 2, wherein the assembly and disassembly means comprises means to assemble the second mold while the first mold is in the working station.

7. An arrangement as claimed in claim 2, wherein the parts of the second mold are loosely superimposed during assembly of the second mold in the changing station.

8. An arrangement as claimed in claim 2, wherein the second mold includes snap closures to connect together the parts of the second mold during assemby thereof in the changing station.

9. An arrangement as claimed in claim 1, wherein the first mold includes upper and lower portions of a core box, a blasting head plate adapted to be connected to the blasting unit for movement therewith and with the slide carriage, and an ejector plate adapted to be connected to the hardening unit for movement therewith and with the slide carriage.

10. An arrangment as claimed in claim 1, wherein the changing station includes first and second processing areas.

11. An arrangement as claimed in claim 1, wherein the foundry machine is for use with molds of the type including a multitude of parts defining a plurality of horizontal surfaces, said parts being releasably connected together with said surfaces placed one on top of another to form a mold.

12. An arrangement as claimed in claim 1, wherein the foundry machine is for use with molds of the type including a multitude of parts defining a plurality of vertical surfaces, said parts being releasably connected together with said surfaces placed side by side against one another to form a mold.

13. An arrangement as claimed in claim 2 wherein:

selected parts of the second mold are connected to, and picked up by, selected parts of the foundry machine according to a predetermined sequence; and at least one of the foundry machine and the second mold includes a plurality of snap closures to connect the selected parts of the second mold to the selected parts of the foundry machine.

14. An arrangement as claimed in claim 13, wherein:

the parts of the second mold comprises a blasting head plate, an ejector plate, and upper and lower portions of a core box;

the foundry machine further includes a clamping assembly including upper and lower frame members; and the plurality of sanp closures includes first snap closures to connect the blasting head plate to the blasting unit, second snap closures to connect the ejector plate to the hardening unit, and third snap closures to connect the upper portion of the core box to upper frame member of the clamping assembly.

15. An arrangement as claimed in claim 14, wherein the changing station includes first and second processing areas located in series behind each other and to the side of the working station; and the transferring means includes means for transporting the first and second molds between said first and second processing areas of the changing station.

16. An arrangement as claimed in claim 13, wherein the changing station includes means to preheat the second mold, and means to cool the first mold.

17. In combination with a foundry machine including a blasting unit, a hardening unit and a work station for supporting molds, an arrangement for changing said molds, the improvement comprising:

each mold includes a plurality of separable parts including a core box, a blasting headplate and an ejector plate;

the foundry machine further includes i. a slide carriage supported for horizontal reciprocating movement along a first, horizontal axis, and ii. clamping means extending upward from the work station, and including an upper frame for holding said one mold in an operating position in the foundry machine, and a lower frame to move said one mold vertically along a second, vertical axis between the operating position and the work station;

the blasting unit is connected to the slide carriage for horizontal movement between a first location, directly above said operating position, and a second location, rearward of said first location;

the hardening unit is connected to the slide carriage for horizontal movement between said first location and a third location, forward of said first location;

means to connect the blasting headplate to the blasting unit for horizontal movement therewith along said first axis between said first and second locations;

means to connect the ejector plate to the hardening unit for horizontal movement therewith along said first axis between said first and third locations;

a changing station located outside and adjacent the foundry machine for holding another of said molds; and means for transferring said one and another molds between the work and changing stations along a third, horizontal axis perpendicular to both said first and second axes.

18. An arrangement according to claim 17 wherein the changing station includes:

a first processing station for holding said one mold;

a second processing station for holding said another mold; and means to move said first and second processing stations together along a fourth, horizontal axis to move the first processing station between a fourth location, directly beside the work station, and a fifth location, rearward of said fourth location, and simultaneously to move said second processing station along said fourth axis between said fourth location and a sixth location, forward of said fourth location.

* * * * *

UNITED STATES PATENT AND TRADEMARK OFFICE

CERTIFICATE OF CORRECTION

PATENT NO. : 4,673,022

DATED : June 16, 1987

INVENTOR(S) : Horst Mitzner

It is certified that error appears in the above-identified patent and that said Letters Patent is hereby corrected as shown below:

On the title page, in the name of the assignee, change "Poper" to--Roper--

Signed and Sealed this

Twenty-sixth Day of April, 1988

*Attest:*

*Attesting Officer*

DONALD J. QUIGG

*Commissioner of Patents and Trademarks*